US006530195B1

(12) United States Patent
Summerfield

(10) Patent No.: US 6,530,195 B1
(45) Date of Patent: Mar. 11, 2003

(54) ANIMAL PACK SADDLE

(76) Inventor: Rex A. Summerfield, 2050 Wilson Creek Rd., Weippe, ID (US) 83553

( * ) Notice: Subject to any disclaimer, the term of this patent is extended or adjusted under 35 U.S.C. 154(b) by 0 days.

(21) Appl. No.: 09/945,446

(22) Filed: Aug. 31, 2001

(51) Int. Cl.[7] ..... B68C 1/02; B68C 3/08
(52) U.S. Cl. ..... 54/37.1; 54/44.1; 54/66
(58) Field of Search ..... 54/37.1, 44.1, 54/44.5, 65, 66; 224/101, 241, 905

(56) References Cited

U.S. PATENT DOCUMENTS

| | | | | | |
|---|---|---|---|---|---|
| 39,285 | A | | 7/1863 | Gosker | |
| 413,501 | A | | 10/1889 | Egger | 54/37.1 |
| 501,821 | A | | 7/1893 | Browne | 54/37.1 |
| 618,329 | A | | 1/1899 | Calvert | 54/37.1 |
| 652,587 | A | | 6/1900 | Bliss | 54/37.1 |
| 751,324 | A | | 2/1904 | Morgan | 54/37.1 |
| 806,781 | A | | 12/1905 | Daly | 54/44.1 |
| 865,661 | A | | 9/1907 | Szameitat | 54/37.1 |
| 1,175,731 | A | | 3/1916 | Enyeart | 54/37.1 |
| 1,239,755 | A | | 9/1917 | Bader | 54/37.1 |
| 1,239,756 | A | | 9/1917 | Bader | 54/37.1 |
| 1,982,839 | A | | 12/1934 | Swanson | 54/37.1 |
| 4,136,506 | A | * | 1/1979 | Miller | 54/66 |
| 4,171,760 | A | | 10/1979 | Gay | 224/241 |
| 4,185,444 | A | | 1/1980 | Conken | 54/37.1 |
| 5,267,428 | A | | 12/1993 | Mayo | 54/37.1 |
| 5,419,103 | A | | 5/1995 | Edwards | 54/37.1 |
| 5,644,902 | A | | 7/1997 | Kemp | 54/37.1 |
| 5,737,907 | A | | 4/1998 | Riley | 54/37.1 |
| 5,884,459 | A | * | 3/1999 | Biddlecome | 54/44.1 |
| 6,363,698 | B1 | * | 4/2002 | Swain | 54/44.1 |

* cited by examiner

*Primary Examiner*—Charles T. Jordan
*Assistant Examiner*—Elizabeth Shaw
(74) *Attorney, Agent, or Firm*—Law Office of Duncan Palmatier

(57) ABSTRACT

The present invention discloses an animal pack saddle with a pivotally and adjustably mounted side board that is contoured to the shape of the pack animal. The cross bucks of the present invention have upwardly extending hook arms forming rings through which bag or pannier straps may be securely looped, as well as hung. Also disclosed is a saddle pad with closeable pockets for securing the side boards.

23 Claims, 6 Drawing Sheets

Fig. 4a
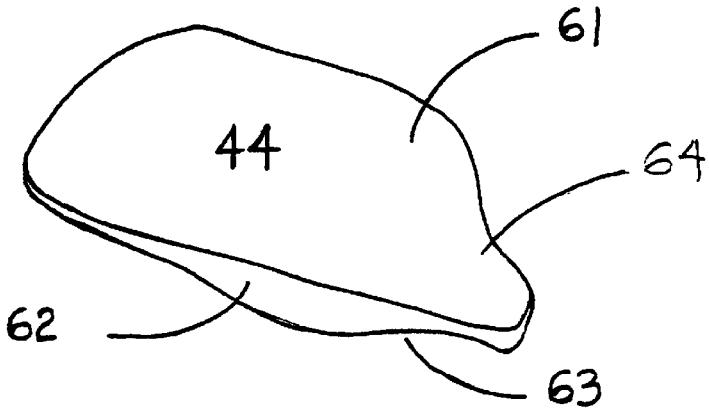
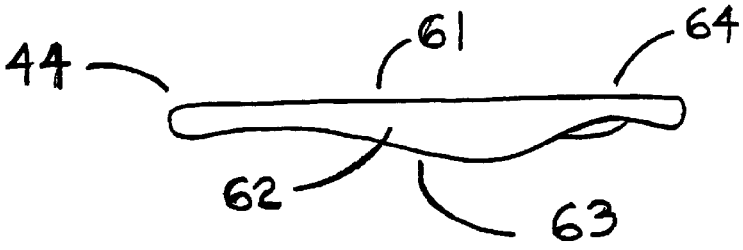
Fig. 4b
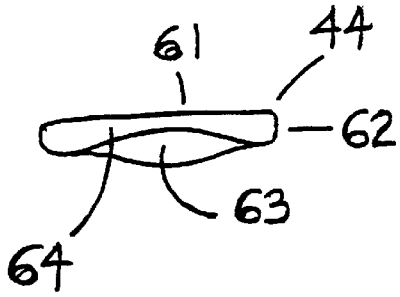
Fig. 4c

ANIMAL PACK SADDLE

The present invention discloses an animal pack saddle with a pivotally and adjustably mounted side board that is contoured to the shape of the pack animal. The cross bucks of the present invention have upwardly extending hook arms forming rings through which bag or pannier straps may be securely looped, as well as hung. Also disclosed is a saddle pad with closeable pockets for securing the side boards.

BACKGROUND OF THE INVENTION

This invention relates to animal pack saddles. Such saddles are strapped to a pack animal's back and are designed to carry a load.

Pack saddles are ancient. A traditional design, still in wide use, is shown in FIG. 1. A pack saddle frame (shown generally at 10) consists of two wooden cross bucks (1) rigidly secured to side boards (2) at the bottom ends (3) of the cross bucks (1). A girth strap (4) is looped about the hook arms (8) of one of the cross bucks (1) and cinches the pack saddle about the belly of the animal (not shown). A lateral strap (5) extends about the hind and fore quarters of the animal to secure the pack saddle laterally. A saddle pad (shown generally at 9) is placed between the animal and the side boards (2) to prevent the pack saddle from chafing the animal. Modern saddle pads are often constructed of a tough upper material (6), such as nylon, and a softer lower material (7), such as felt, to provide a durable surface between the pack saddle and saddle pad as well as a soft and breathable surface between the animal and the saddle pad (9). Bags (not shown) are hung from the hook arms (8) by straps (11) looped over a hook arm (8). Although most pack saddles frames are constructed of wood, some have been formed of other materials, such as metal, but in the traditional structure.

The traditional pack saddle has several drawbacks. Because conventional pack saddles provide little or no conformity to the animal's shape, they tend to slip from side to side, especially if the weight of each pack on either side of the animal is not equal and balanced. Sometimes the pack saddle frame and saddle pad will slip off the side of the animal together, and other times the saddle frame will slip on the top of the saddle pad. Traditional pack saddles tend to be built as "one-size-fits-all" for a particular type of pack animal and provide little or no adjustment to account for different sizes within the same type of animal. Thus, a pack saddle designed for a 150 pound pack goat will be loose on a 125 pound goat and tight on a 175 pound animal. The hook arms of traditional pack saddles rely entirely on gravity to hang bags, thereby allowing for occasional loss of the bags as they bounce up and down, especially under light loads.

SUMMARY OF THE INVENTION

It is one of the objects of the present invention to provide an animal pack saddle with side boards that conform to the shape of the animal, thereby creating a more secure and stable fit. It is another object of the present invention to provide an animal pack saddle that is adjustable to fit different sized pack animals, thereby also creating a more secure and stable fit. It is another object of the present invention to provide an animal pack saddle that secures the pack saddle frame to the saddle pad, thereby preventing slippage. It is another object of the present invention to provide an animal pack saddle with upwardly extending hook arms forming rings for bag or pannier straps, thereby creating a more secure anchoring point.

In one embodiment of the present invention, a pack saddle frame is comprised of two aluminum cross bucks. The hook arms of the cross buck form two rings, designed as attachment points through which bag straps may be looped, as well as forming the traditional X-shaped hook arms over which straps may be hung. In a preferred embodiment, the junction of the hook arms has a hole that may also be used for securing straps, as well as decreasing the cross buck's weight. Side boards are pivotally and adjustably attached to the bottom ends of the cross bucks. The pivotability and adjustability of the side boards allows the pack saddle securely to fit a far greater range of pack animal sizes. Adjustable girth straps, that can be moved forward or backward, also provide better fit. The side boards of the present invention are molded to contour to the shape of the type of pack animal being used. For example, for a pack goat, the side boards have contours that align with the goat's spine, ribs, shoulder blades and haunches. The contoured side board provides a closer fit between the pack animal and saddle, thereby preventing the pack saddle and load to shift. Also disclosed is a novel saddle pad with pockets for the side boards. The pockets keep the pack saddle frame from sliding around on the saddle pad, thereby making the pack saddle more secure and preventing bags or panniers from shifting.

The present invention was conceived and originally designed by the inventor for use with pack goats. However, the invention has features that make it useful to other pack animals, such as a horses, asses, mules, llamas, or even elephants.

BRIEF DESCRIPTION OF THE DRAWINGS

FIG. 4*a* is a three-quarter view showing the disclosed side board.

FIG. 4*b* is a side view showing the disclosed side board.

FIG. 4*c* is a head-on view showing the disclosed side board.

DESCRIPTION OF THE PREFERRED EMBODIMENT

Figure 1:
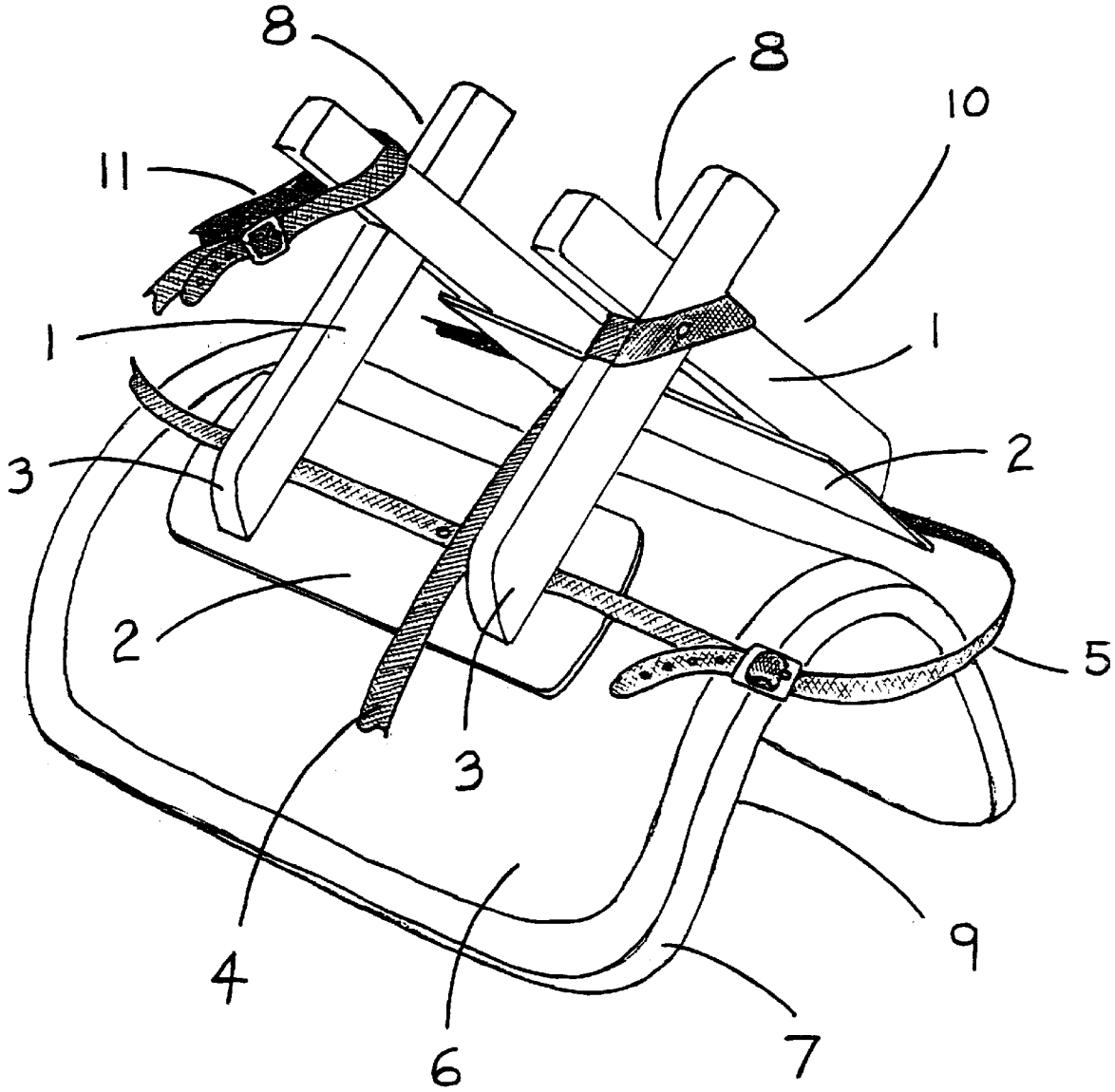
Fig. 1 (prior art)
FIG. 1 is a three-quarter view of a prior art pack saddle and saddle pad.
Figure 2:
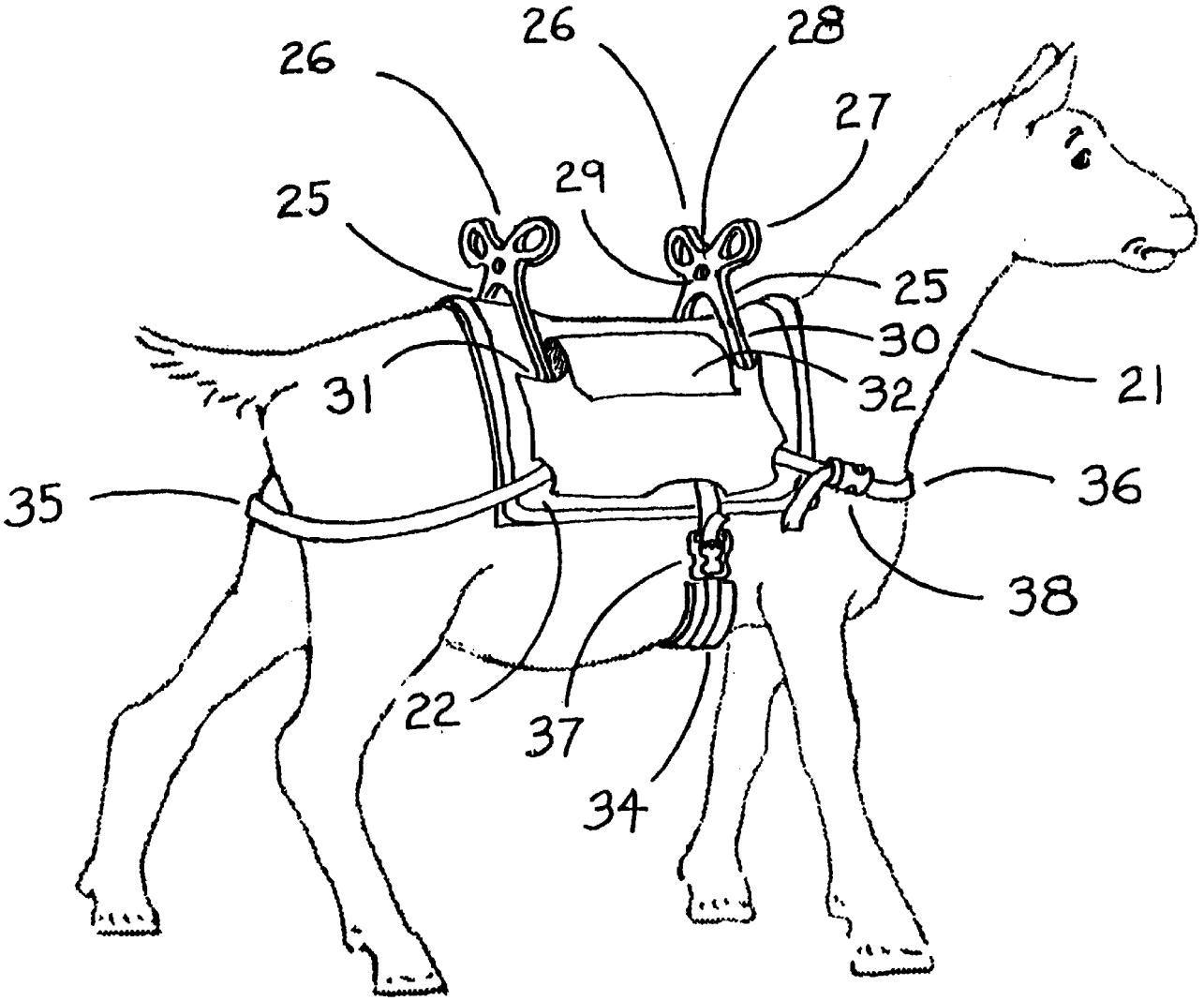
FIG. 2 is a side view showing a preferred embodiment of the disclosed saddle pack frame and saddle pad on a pack goat.
Figure 3:
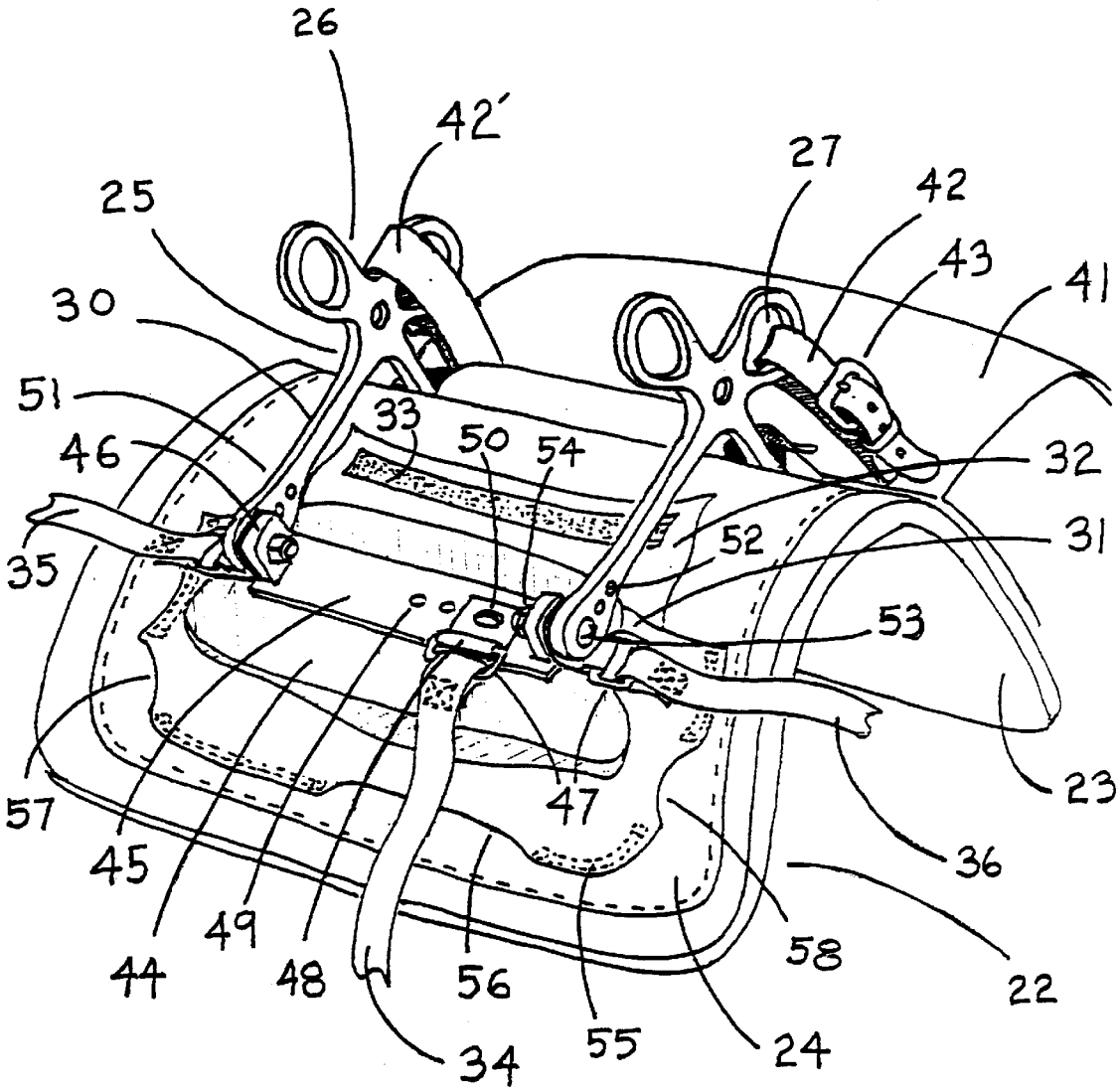
FIG. 3 is a three-quarter view showing the disclosed saddle pack frame and saddle pad.
Figure 5:
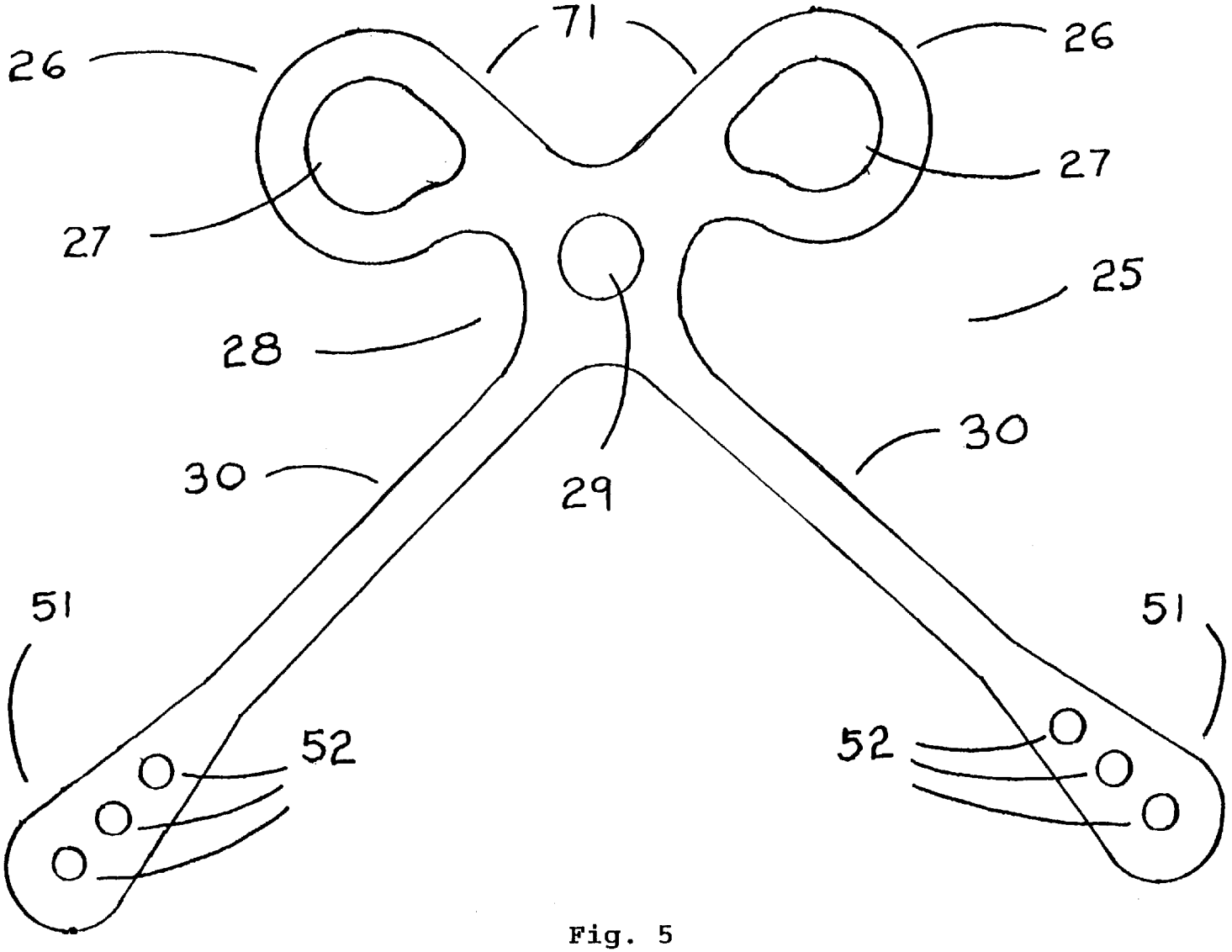
FIG. 5 is a front view showing the disclosed cross buck.

FIG. 2 shows one embodiment of the present invention mounted on a pack goat (21). Although a pack goat is shown here, the invention has equal application to pack saddles for other pack animals, such as a horses, asses, mules, llamas, or even elephants. A saddle pad (22) is formed of a bottom material (23) and a top material (24). To prevent chafing and saddle sores and to provide some breathability for the animal, the bottom material (23) is ideally constructed from a felt material. Onto the bottom material (23), a separate top material (24), such as nylon or cordura, can be attached, which provides a durable surface for the pack saddle. Referring to FIG. 3, the pack saddle is formed of two cross bucks (25). The cross bucks (25) are pivotally and adjustably attached to contoured side boards (44). A cross brace (45) is mounted on the side board (44). In the preferred embodiment disclosed here, the contoured side board (44) is molded in plastic and the cross brace (45) is attached to the side board (44) during the molding process. However, it will be appreciated that the cross brace (45) can be attached to the side board (44) in many conventional ways, such as by glue or screws. Moreover, the side board can be formed of different materials, such as wood, metal or plastic, and can be made by many conventional methods, such as molding, machining, sculpting or carving. Brackets (46) at each end of the cross brace (45) receive the shafts of bolts (53), and the bolts are retained in place by nuts (54). The bolts (53) pass through holes (52) at the bottom end (51) of the arms (30) of the cross bucks (25). As shown in FIG. 5, the cross buck (25) has a plurality of holes (52) at the bottom ends (51) of its arms (30). Thus, as seen in FIG. 3, the bolts (53) may be placed through any of the holes (52) in the cross buck's arm (30), so that the side board (44) can be adjusted to a position higher or lower on the arm (30). In this way, the pack saddle may be adjusted so that the side boards (44) will fit a large range of animal sizes. In addition, the cross brace brackets (46) can pivot on the bolt (53), providing further conformity to the animal. As seen in FIGS. 2 and 3, a girth strap (34) attaches to the cross brace (45) by a D-ring (47) and a D-ring bracket (48). The bracket (48) is secured to the cross brace (45) by a screw (50). FIG. 3 shows that the girth strap (34) is screwed to the cross brace (45) in the forward most position, but a plurality of additional screw holes (49) allow the girth strap (34) to be secured by the D-ring bracket (48) in different positions, thereby providing additional adjustment to fit a particular animal.

Figure 6:
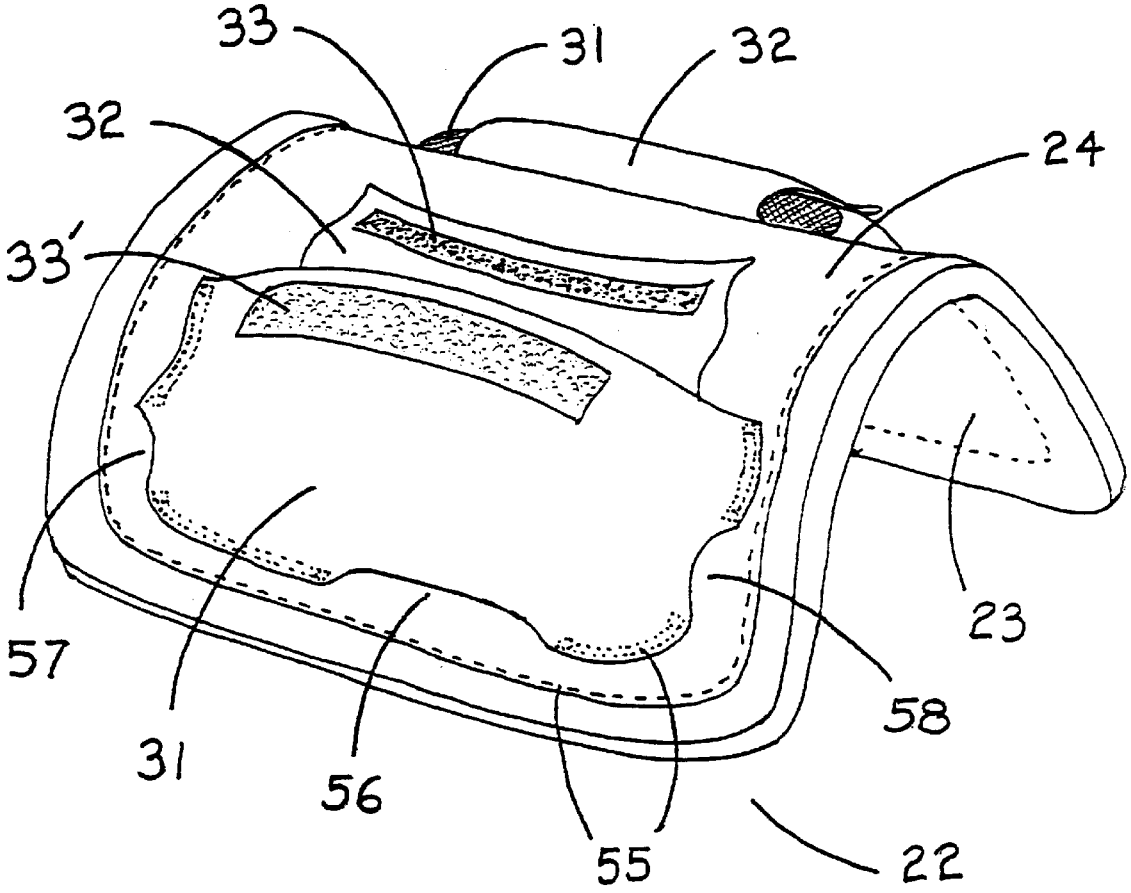
FIG. 6 is a three-quarter view showing the disclosed saddle pad.

As seen in FIGS. 2, 3 and 6, the saddle pad (22) has pockets (31) that receive the side boards (44). When the side board (44) is in the pocket (31), a flap (32) may be closed over the outside of the pocket (31). In the preferred embodiment seen in FIG. 6, the pockets (31) are stitched (55) to the top material (24) of the saddle pad (22), and the flaps (32) are secured to the outside of the pockets (31) by strips of press-fit material (33 and 33'), such as Velcro. However, it will be readily appreciated, that many conventional ways exist to secure a pocket flap, such as buckles, snaps, buttons, zippers, and the like. FIG. 2 shows the pack saddle in place on the animal (21), with a flap (32) closed over a pocket (31), and the cross buck arms (30) extending out of the sides of the pocket (31). The girth strap (34) can be seen emerging from a girth strap passage (56, as seen in FIGS. 3 and 6) in the pocket (31). The girth strap is cinched about the animal's belly and held in place by a buckle (37). A fore quarter strap (36) emerges from a fore quarter strap passage (58, as seen in FIGS. 3 and 6) in the pocket (31). A hind quarter strap (35) emerges from a hind quarter strap passage (57, as seen in FIGS. 3 and 6) in the pocket (31). A buckle (38) cinches the fore and hind quarter straps (36 and 35). As seen in FIG. 3, the fore and hind quarter straps (36 and 35) are attached by D-rings (47) to the cross brace (45). For purposes of illustration, FIG. 3 shows the foreground side board (44), along with the straps (34, 35 and 36), outside and on top of the saddle pad pocket (31), and the far side flap (32) is shown in place covering the far side board (44), which is hidden in the pocket (31). When the side board (44) is inserted in the pocket (31), the girth, fore quarter and hind quarter straps (34, 35 and 36) can be threaded through the girth, fore quarter and hind quarter passages (56, 58 and 57) in the pocket (31).

FIG. 5 shows the construction of the cross buck (25). Two arms (30) extend and splay downwardly at an angle. As described above, the bottom ends (51) of the arms (30) have holes (52) to receive a bolt or pin (53, as seen in FIG. 3), on which the cross brace bracket (46, as seen in FIG. 3) may pivot. It will be appreciated that many conventional pivot arrangements are possible. The cross buck arms (30) come together at a junction (28) and splay upwardly, forming the hook arms (26). The top of each hook arm (26) forms a hook (71) which provides the traditional place to hang bag straps (42', as seen in FIG. 3). In addition, each hook arm (26) is formed into a ring (27), through which bag straps (42, as seen in FIG. 3) may be secured. A hole (29) in the junction (28) provides an additional place to secure straps (42) or hooks. The cross buck (25) may be constructed of many materials, such as wood, metal or plastic. In the preferred embodiment disclosed here, the cross buck (25) is made of aluminum, which is strong, light, resilient, corrosion-resistant, and easy to manufacture. The aluminum cross buck (25) of the preferred embodiment is machined from billet, but it could also be molded or forged.

FIG. 3 shows two ways a bag or pannier (41) may be secured to the hook arms (26) of the saddle pack. The forward bag strap (42) is shown looped through one of the hook arm rings (27) and secured with a buckle (43). The rearward bag strap (42') is shown mounted in the traditional way, by hanging it over the hook (71, as seen in FIG. 5) of the hook arm (26). It will be appreciated that, if a bag (41) is hung from the hook (71) of a hook arm (26), then it is possible for the bag strap (42') to bounce up and off the hook (71) as the animal walks. This is more likely under light loads. Thus, the hook arm rings (27) provide a more secure mounting for a bag strap (42). In addition, as seen in FIGS. 2 and 5, a hole (29) in the junction (28) of the hook arms (26) provides another passage for straps or hooks.

FIGS. 4*a*, 4*b* and 4*c* show three views of the contoured side board (44) of the present invention. Traditional side boards are made from wood or metal planks, and some flexibility in the planks is sometimes provided to allow the planks a limited amount of conformity to the animal. The present invention discloses a contoured side board (44) that is constructed to provide a much greater degree of conformity to the animal, thereby preventing the side boards (44) from shifting over the animal's back. The top surface (61) of the contoured side board (44) is flat, but the bottom surface (63) has high and low portions that conform to the shape of the type of pack animal for which the side board (44) is designed. FIGS. 4*a–c* show a side board (44) made for a pack goat. Thus, the side board (44) is not a conventional rectangular shape; rather, the forward part (64) of the side board (44) dips down to allow a space for a goat's shoulder blade. In addition, the side view (62) shows that the bottom surface (63) has a raised portion that conforms to the shape of the part of the goat where the side boards (44) rest when in place. The shape of the side board (44) and the contour of the bottom surface (63) will depend on the type of pack animal for which the pack saddle is intended. In the case of the preferred embodiment disclosed here, the side board (44) was designed to conform to the shape of that part of the back of a pack goat where the side boards (44) rest. To create the shape, clay was pressed against a pack goat in order to create a template. From the clay template a carved wood template was created, and a rubber mold was formed over the wood template. The mold was used to make plastic copies of the contoured side board (44). However, other conventional techniques can be used to make contoured side boards (44), such as CNC machining, carving or sculpting. It will be appreciated that the side boards (44) may be made of many materials other than plastic, such as wood or metal. The preferred embodiment of the contoured side boards (44) disclosed here are shown for a pack goat, but contoured side boards may be created to conform to the shape of any pack animal.

The drawings and description set forth here represent only some embodiments of the invention. After considering these, skilled persons will understand that there are many ways to make an animal pack saddle according to the principles disclosed. The inventor contemplates that the use of alternative structures, materials, or manufacturing techniques, which result in an animal pack saddle according to the principles disclosed, will be within the scope of the invention.

What I claim is:

1. An animal pack saddle comprising:

at least two cross bucks, each cross buck having at least two downwardly splayed arms, each arm having a bottom end, at least two side boards, each side board being pivotally mounted on shafts located at the bottom ends of the arms, a plurality of bores at the bottom ends of the arms, said bores receiving the shafts and allowing the pivotally mounted side boards to be adjustably mounted on the arms.

2. The animal pack saddle of claim 1 further comprising a girth strap secured to a side board at a securing point, wherein the side board has a plurality of securing points for adjustably mounting the girth strap.

3. The animal pack saddle of claim 2 wherein the side board has a cross brace, and the plurality of securing points for the girth strap are located on the cross-brace.

4. The animal pack saddle of claim 3 wherein the girth strap is secured by a screw to any of the plurality of securing points on the cross brace of the side board.

5. The animal pack saddle of claim 1 wherein the shafts for pivotally and adjustably mounting the side boards are bolts.

6. The animal pack saddle of claim 1 wherein the shafts for pivotally and adjustably mounting the side boards are pins.

7. The animal pack saddle of claim 1 wherein the side boards have a bottom surface contoured to conform to the shape of the part of a pack animal where the side boards rest.

8. The animal pack saddle of claim 7 wherein the contoured side boards are molded.

9. The animal pack saddle of claim 1 wherein the cross buck has upwardly splayed hook arms, wherein each hook arm forms a ring.

10. The animal pack saddle of claim 1 further comprising a saddle pad, wherein the saddle pad has a top surface and the top surface has pockets for receiving the side boards.

11. The animal pack saddle of claim 10 further comprising flaps on the top surface of the saddle pad, wherein the flaps close the pockets of the saddle pad and secure the side boards in the pockets.

12. The animal pack saddle of claim 1 wherein the cross buck has upwardly splayed hook arms, and wherein each hook arm forms a ring, and wherein the side boards have a bottom surface contoured to conform to the shape of the part of a pack animal where the side boards rest.

13. The animal pack saddle of claim 12 further comprising a saddle pad, wherein the saddle pad has a top surface and the top surface has pockets for receiving the side boards.

14. An animal pack saddle comprising a cross buck having upwardly splayed hook arms, wherein the hook arms have top ends, and the top ends form rings sized to receive straps through the rings.

15. Side boards for an animal pack saddle, each side board comprising a bottom surface contoured to conform to a shape of a side of a pack animal where the side board rests, and a cut-out in each side board at the pack animal's shoulder blade.

16. The animal pack saddle side boards of claim 15 wherein the contoured side boards are molded.

17. The animal pack saddle side boards of claim 15 wherein the contoured side boards are formed of plastic.

18. The animal pack saddle side boards of claim 15 wherein the contoured side boards are machined.

19. The animal pack saddle side boards of claim 15 wherein the contoured side boards are carved.

20. The animal pack saddle side boards of claim 15 wherein the contoured side boards are formed in wood.

21. A saddle pad for an animal pack saddle comprising a top surface with a pocket, wherein the pocket is sized to receive a pack saddle side board, and further comprising a fastener to close the pocket and secure the sideboard therein.

22. The saddle pad of claim 21 wherein the fastener is a flap on the top surface of the saddle pad that closes the flap over the opening of the pocket.

23. A method for making side boards for an animal pack saddle, comprising the steps of:

Taking a mold of a pack animal's side and obtaining a contoured shape of the pack animal's side therefrom, and forming a side board with a bottom surface, wherein the bottom surface has a contoured shape equivalent to the mold of the pack animal's side.

* * * * *